US005324167A

United States Patent [19]

Moczadlo et al.

[11] Patent Number: 5,324,167

[45] Date of Patent: Jun. 28, 1994

[54] CENTRIFUGAL FAN

[75] Inventors: Raymond Moczadlo, Doylestown; Kenneth Cerklefski, West Salem, both of Ohio

[73] Assignee: TLT-Babcock, Inc., Akron, Ohio

[21] Appl. No.: 109,649

[22] Filed: Aug. 20, 1993

[51] Int. Cl.[5] ..... F01D 25/24

[52] U.S. Cl. ..... 415/182.1; 415/208.1

[58] Field of Search ..... 415/182.1, 183, 92, 415/102, 208.1, 203, 206

[56] References Cited

U.S. PATENT DOCUMENTS

| | | | |
|---|---|---|---|
| 2,344,456 | 3/1944 | Cassie | 415/208.1 |
| 4,540,338 | 9/1985 | Pukkila | 415/182.1 |
| 4,913,621 | 4/1990 | Reither | 415/211.1 |
| 5,052,888 | 10/1991 | Bolton et al. | 415/182.1 |

*Primary Examiner*—John T. Kwon

*Attorney, Agent, or Firm*—Oldham, Oldham & Wilson, Co.

[57] ABSTRACT

In accordance with the present invention, there is provided a simple solution to retain the vortex in the confined position, within the fan, thereby permitting higher operational fan speeds a lower energy consumption. By using the false-bottom, which eliminates at least one vertex of the rear wall of the inlet chamber, an aerodynamic and structural asymmetry is introduced at the bottom of the inlet box, near the impeller inlet, that is sufficient to retain the impeller vortex totally within the impeller and inlet cone, and prevent its expansion into the inlet box proper, while still permitting the pre-spin effects of the parallel bladed inlet dampers at reduced load conditions.

2 Claims, 3 Drawing Sheets

CENTRIFUGAL FAN

TECHNICAL FIELD

The invention described herein pertains generally to an improved centrifugal fan design in which the vortex remains inside the impeller of the fan and does not migrate outwardly back into the inlet air chambers.

BACKGROUND OF THE INVENTION

The operation of a centrifugal fan is much like that of a centrifugal pump with the pressure developed arising from two sources. There is a centrifugal force due to the rotation of an enclosed volume of air or gas, and a velocity imparted to the air or gas by the blades and partly converted to pressure by the volute or scroll-shaped fan casing.

The centrifugal force developed by the rotor produces a compression of the air or gas that, in fan engineering, is the static pressure. The amount of static pressure developed depends on the ratio of the velocity of the air leaving the tips of the blades to the velocity of the air entering the fan at the heel of the blades. Therefore, the longer the blades, the greater the static pressure developed by the fan. Operating efficiencies of fans are typically between 40 and 70 percent. Operating pressure is the sum of the static pressure and the velocity head of the air leaving the fan. It is generally expressed as inches of water gage, or in ounces per square inch.

The performance of a centrifugal fan varies with changes in conditions such as temperature, speed, and density of the gas. One significant operational problem with centrifugal fans is, that at higher operating conditions, a pulsation in pressure and flow within the centrifugal fan creates an audible beating noise. The cause of this is the creation of an unstable vortex that moves outside the impeller of the fan and into the inlet chamber of the fan.

Prior art solutions to this problem have included the addition of a radial splitter in the bottom of the inlet box. With this configuration, when the vortex escapes its confinement, it is immediately split by its impingement upon the splitter plate. Unfortunately, while this does destroy the vortex, it additionally destroys desirable pre-spin that was imparted to the inlet air by the positioning of the inlet dampers.

To date, there has been no effective solution to the audible pulsating that occurs when centrifugal fans operate in the "wide-open" position, without the attendant problems mentioned.

SUMMARY OF THE INVENTION

In accordance with the present invention, there is provided a simple solution to retain the vortex in the confined position, within the fan, thereby permitting higher operational fan speeds at lower energy consumption.

It is an object of this invention to provide a diverter plate or false bottom to the inlet fan housing.

It is another object of this invention to provide a false bottom which is tapered.

It is yet an additional object of this invention to use the tapered false bottom to cause sufficient asymmetry to prevent the vortex from jumping out of the cone adjacent to the impeller, yet permit retention of desirable pre-spin to the inlet air.

It is still an additional object of this invention to permit a centrifugal fan to operate in a "wide-open" position without audible beating.

These and other objects of this invention will be evident when viewed in light of the drawings, detailed description, and appended claims.

DETAILED DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
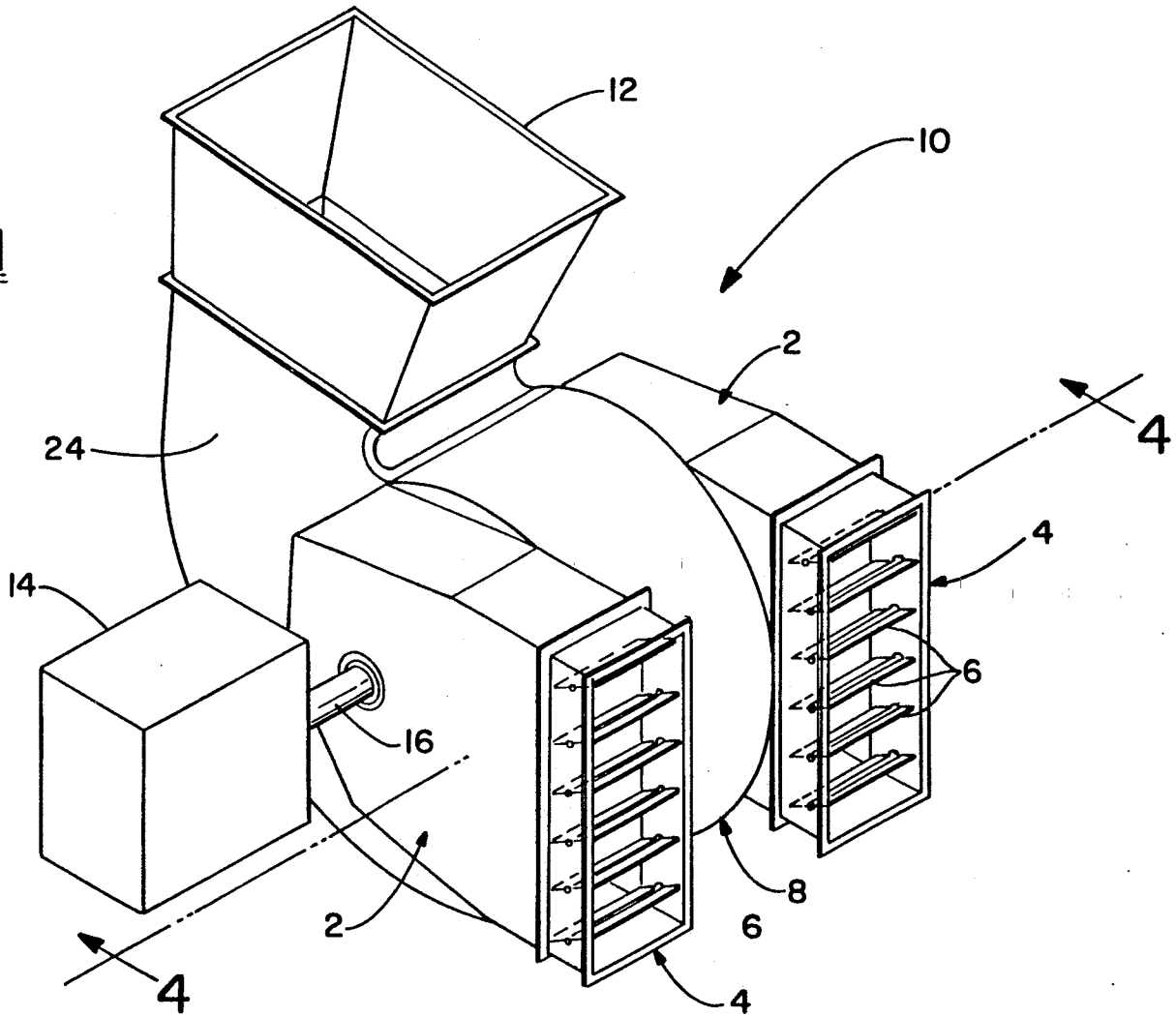
FIG. 1 is a perspective view of the centrifugal fan.

Referring now to the drawings wherein the showings are for purposes of illustrating the preferred embodiment of the invention only and not for purposes of limiting the same, the Figures show an improved centrifugal fan design, particularly as it relates to the fan housing inlet area, which promotes the residence of the vortex inside the wheel of the fan while retaining the desirable pre-spin characteristics imparted through the parallel-bladed inlet dampers.

Figure 2:
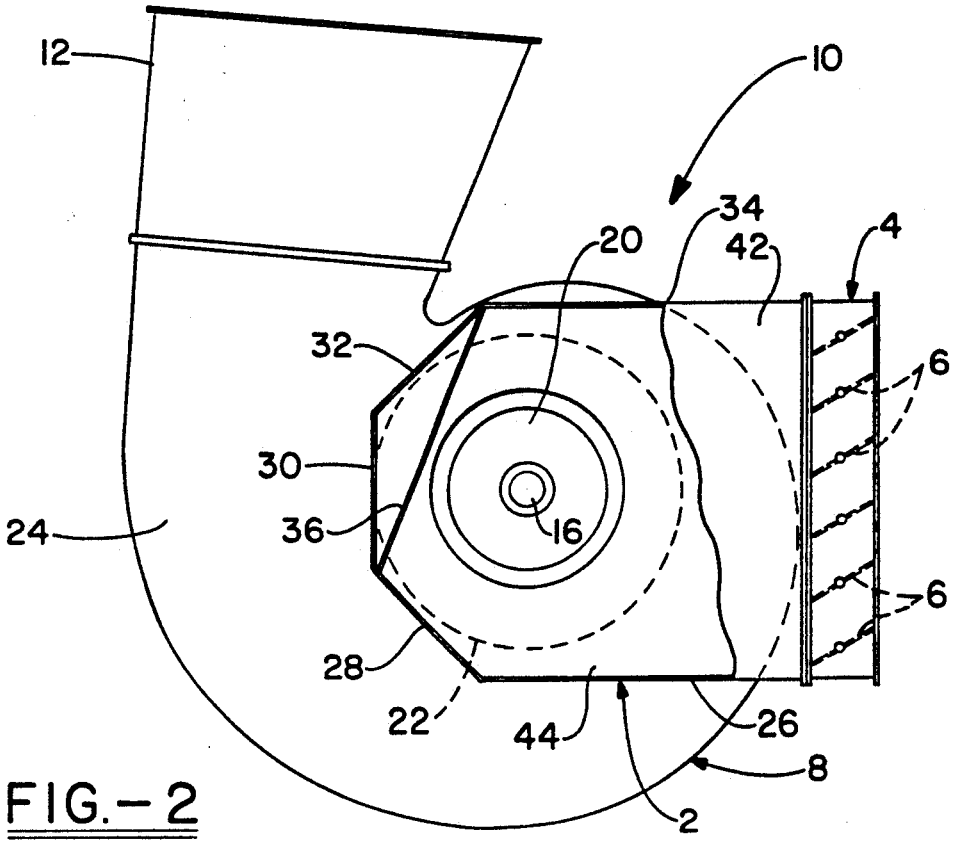
FIG. 2 is a partially cut-away side elevational view of the centrifugal fan showing an air inlet port into the central fan housing and false bottom positioned at the rear of the air inlet chamber.
Figure 3:
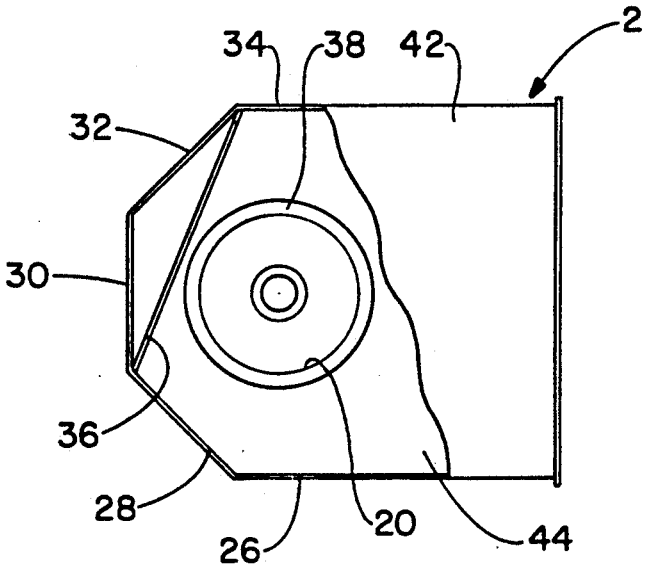
FIG. 3 is an expanded cross-sectional view of the fan inlet with asymmetrical false bottom.
Figure 4:
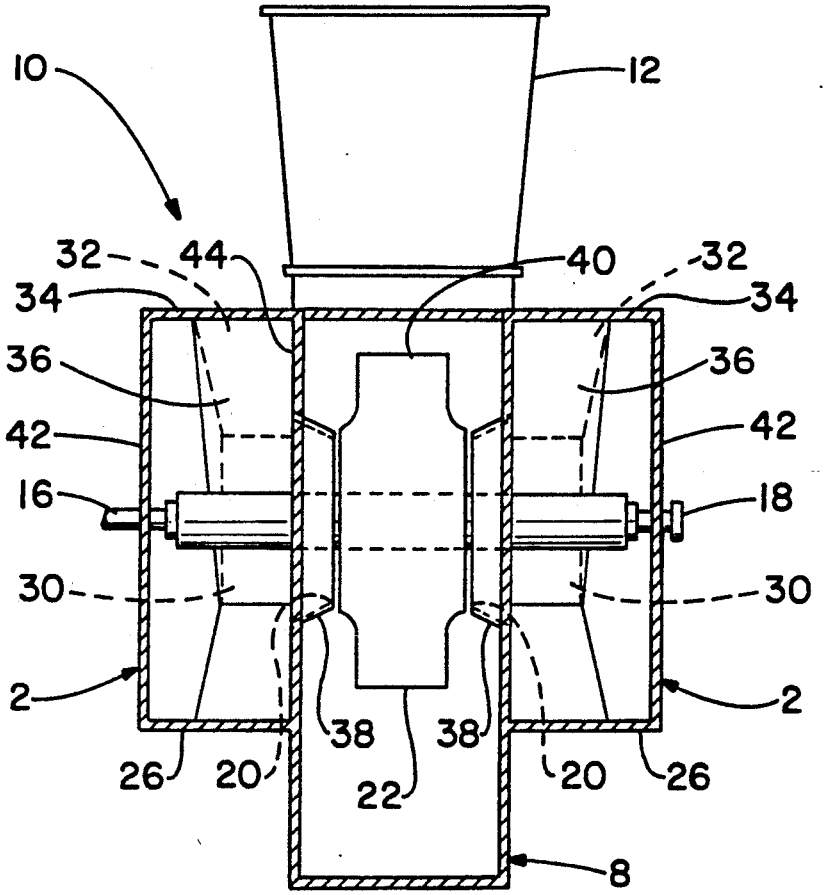
FIG. 4 is a front elevational view of the centrifugal fan along line 4—4 of FIG. 1.

As shown in FIG. 1, as supplemented with reference to FIGS. 2–4 showing interior detail of the centrifugal fan 10 has a pair of inlet housings 4 and a central fan housing 8. A plurality of parallel bladed inlet dampers 6 impart a clockwise rotation pre-spin to the inlet air. In operation, the inlet air flows, with imparted pre-spin through inlet housing 4, into inlet chambers 2 and into inlet ports 20 which lead to impeller 22 residing within central fan housing 8. Through the action of impeller 22, the air is expelled through scroll-shaped exit chamber 24 and returns to the atmosphere via exit chute 12. The mechanical clockwise rotation of impeller 22 is achieved through the action of motor 14 on shaft 16, the end of which is retained by retainer 18.

As shown more clearly in FIGS. 2–4, inlet chambers 2 are roughly n-shaped polygons at their distal end from bladed inlet dampers 6 bounded by bottom wall 26, n-shaped polygon rear wall 28, 30, 32, top wall 34, exterior wall 42 and interior wall 44. The value of n, defined as the number of sides at the distal end of the inlet chamber is typically 3. However, it can be seen that this number can easily be increased. When the value of n is 3, then the angle created between any two adjacent sides will be defined by the formula $360°/(2n+2)$. The denominator of the formula being derived by hypothetically continuing the n-sided polygon to complete the closed shape with the addition of a top and a bottom to the polygon. Therefore, when a value of 3 is chosen for n, the angle is 45°. By introducing asymmetry into the n-shaped polygon region, through the insertion of false-bottom 36, the vortex generated by impeller 22 remains resident within impeller 22 and does not migrate outwardly back into inlet boxes 2. False-bottom 36, as shown in FIG. 3, is positioned to eliminate one intersection of two adjacent sides.

As shown in FIG. 4, impeller 22 contains two inlet cones 38 through which inlet air enters through inlet ports 20 and is expelled through circumferentially radiating fins 40 positioned about the periphery of impeller 22.

Discussion

During centrifugal fan operation, particularly at high velocities, an "instability" develops caused by the inlet vortex at the impeller inlet port jumping out of the rotor/cone, expanding into the inlet chamber and destroying the pressure producing capability of the fan.

Conventional splitter plates, positioned from the bottom of the inlet box to the inlet eye of the housing tend to prohibit this instability by preventing the jumping of the vortex out of the inlet eye of the rotor, in a direction opposite to the primary flow direction of the fan. The repositioning of the vortex immediately lowers the fan's discharge pressure. While conventional splitters do prevent this problem, their presence obliterates the pre-spin effect of the inlet dampers of the fan at reduced load conditions, thereby producing unacceptably low mechanical efficiencies.

By using the false-bottom, which eliminates at least one vertex of the rear wall of the inlet chamber, an aerodynamic and structural asymmetry is introduced at the bottom of the inlet box, near the impeller inlet, that is sufficient to retain the impeller vortex totally within the impeller and inlet cone, and prevent its expansion into the inlet box proper, while still permitting the pre-spin effects of the parallel bladed inlet dampers at reduced load conditions.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. An improved centrifugal fan which has at least one inlet chamber having a plurality of bladed inlet dampers in a front wall of the inlet chamber which impart a pre-spin to the inlet air, the substantially unobstructed inlet chamber additionally having an n-sided rear wall at a distal end from the front wall of the inlet chamber and wherein n is at least 3, an inlet opening in an interior inlet chamber wall which permits the flow of inlet air to a central fan housing containing an impeller which receives the inlet air through an inlet cone adjacent to the inlet opening, the improvement comprising the addition of a false bottom into a rear wall of the inlet chamber define an open space by $(n-1)$ side of the rear walls and the false bottom communicating with the fan housing thereby introducing an asymmetry to the rear area of the inlet chamber which prevents a vortex generated by the impeller from migrating back into the inlet chamber without destroying the pre-spin imparted to the inlet air by the bladed inlet dampers.

2. The centrifugal fan claim 1 wherein the asymmetry is introduced by positioning the false-bottom so that one vertex of the n-sided rear wall is eliminated.

* * * * *